United States Patent [19]

Poradowski

[11] 4,009,355

[45] Feb. 22, 1977

[54] REVERSIBLE ANTI-NOISE MICROPHONE

[75] Inventor: Lech M. Poradowski, Yonkers, N.Y.

[73] Assignee: Roanwell Corporation, New York, N.Y.

[22] Filed: July 2, 1975

[21] Appl. No.: 592,632

[52] U.S. Cl. ..... 179/121 D; 179/179

[51] Int. Cl.[2] ..... H04R 1/02; H04R 1/38

[58] Field of Search ..... 179/1 D, 146 R, 107 FD, 179/121 R, 121 D, 138 R, 138 VL, 178, 179, 180; 174/52 R; 325/119

[56] References Cited

UNITED STATES PATENTS

| | | | |
|---|---|---|---|
| 2,196,342 | 4/1940 | Ruttenberg | 179/138 VL |
| 2,301,638 | 11/1942 | Olson | 179/138 VL |
| 2,305,598 | 12/1942 | Bauer | 179/121 D |

*Primary Examiner*—George G. Stellar
*Attorney, Agent, or Firm*—Cooper, Dunham, Clark, Griffin & Moran

[57] ABSTRACT

This microphone has two opposed faces. The sound to be picked up may be directed toward either one of the two opposed faces with equivalent electrical output from the microphone in either case. Since background noise impinges equally on both of the two opposed faces, its effect on the microphone diaphragm is self-canceling, and causes substantially zero output from the transducer.

4 Claims, 10 Drawing Figures

REVERSIBLE ANTI-NOISE MICROPHONE

CROSS-REFERENCE

This microphone is intended for use in a communications headset of the type shown and claimed in the copending application of James P. Foley, Ser. No. 555,529, filed Mar. 5, 1975.

BRIEF SUMMARY

A microphone typically includes a diaphragm which is vibrated by sound waves impinging upon it. The diaphragm may carry an electrostatic element, e.g., an electret or a capacitor plate cooperating with a stationary electrostatic element. Alternatively, the diaphragm may carry a magnetic element cooperating with a stationary magnetic element. In either case, the cooperating elements vary an electrical condition as a function of the sound waves impinging on the diaphragm. The stationary element is coupled to a suitable electrical circuit. Acoustic waves impinging on the diaphragm are converted to electrical waves in the circuit by the action of the transducer.

Anti-noise microphones commonly have two unequal acoustic paths by which sound waves reach the opposite sides of the diaphragm. One path, directed toward the sound source, receives both the sound to be picked up and the background noise, and the other path, opening away from the sound source, receives primarily background noise. In most anti-noise microphones of the prior art, a leakage opening of adjustable dimensions is provided between the two acoustic paths.

A microphone constructed in accordance with the present invention has two opposite faces and two acoustic paths connecting the respective faces to the respective sides of the diaphragm. The speaker's voice, or other sound to be picked up, may be directed toward either face of the microphone, and the background noise is received at both faces. The two acoustic paths are completely separate.

Transducers are typically not physically symmetrical. The acoustic paths by which the sound waves reach the opposite sides of the diaphragm cannot be symmetrical because of the fundamental asymmetry of the transducer. Since the microphone is to respond equally to sound impinging upon it from either of the opposite faces, the two acoustic paths leading to the diaphragm from those opposite faces must be balanced. One path is acoustically longer than the other, and balance is secured by introducing into the paths acoustical impedances inversely related to the acoustic lengths of the paths.

DRAWINGS

DETAILED DESCRIPTION

Figure 1:
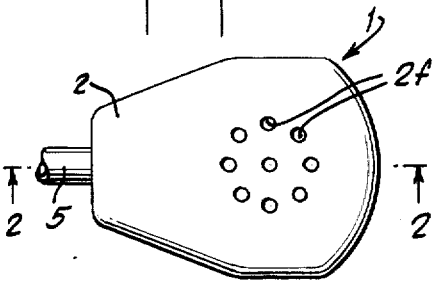
FIG. 1 is a plan view, on an enlarged scale, of a microphone embodying the invention.
Figure 2:
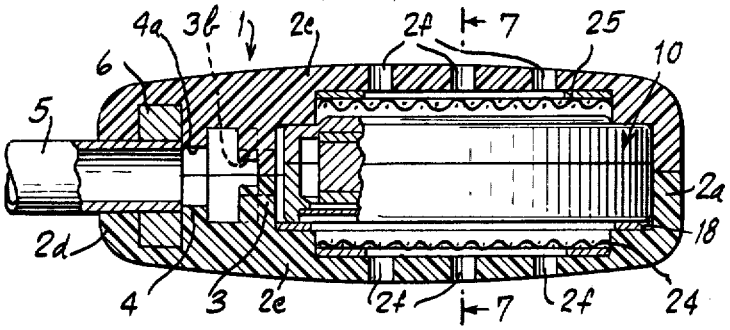
FIG. 2 is a sectional view taken along the line 2—2 of FIG. 1, on a further enlarged scale.
Figure 3:
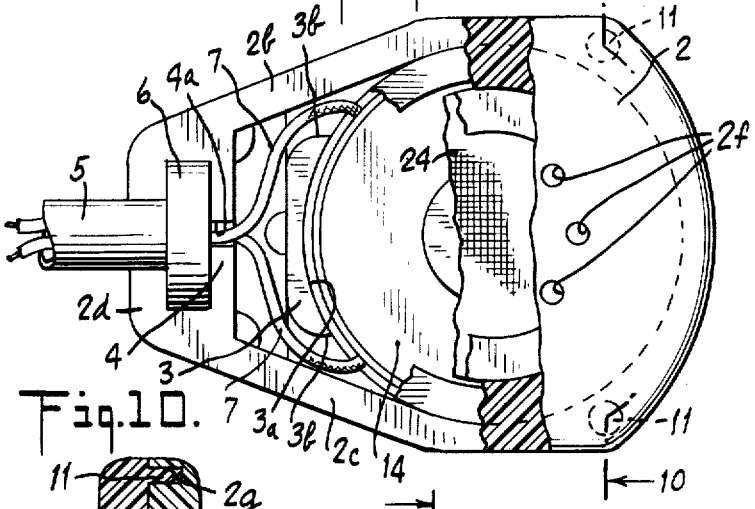
FIG. 3 is a view of the microphone of FIG. 2, partly in plan, with certain parts broken away to reveal the internal structure.

The microphone of the invention is enclosed in a housing 1 consisting of two identical parts, each indicated by the reference numeral 2. Each part, as best seen in FIGS. 2 and 3, consists of a face or transverse wall **2*e* and a peripheral wall projecting fron one side of the face wall. The peripheral wall includes a first section 2*a*, of part-cylindrical contour, having an inner face of constant radius and somewhat greater than a semicylinder. Second and third wall sections 2*b* and 2*c* have flat inner surfaces extending tangentially from the ends of the first section 2*a* to an end section 2*d* appearing at the left end of FIGS. 2 and 3. Face wall 2*e* is provided with sound transmitting openings 2*f***.

A septum 3 having a part-cylindrical surface **3*a* extends across the part 2 between the right-hand ends of the second and third wall sections 2*b* and 2*c*, as they appear in FIG. 3. Another septum 4 extends between the second and third wall sections 2*b* adjacent their left-hand ends as they appear in FIG. 3. The two housing parts 2 are placed with the end surfaces of their peripheral walls and of their septums in abutting contact (FIG. 2**).

A conduit 5 extends through facing recesses in the end wall sections **2*d* and has its right-hand end attached to an anchor ring 6, as by welding. Anchor ring 6 is received in a recess defined by wall sections 2*b* and 2*d* and by septums 4. Two wires 7 extend through the conduit 5 and through aligned notches 4*a* in the surfaces of the transverse septums 4. The wires 7 separate in the recess defined by the septums 3 and 4 and the second wall section 2*b*. The septums 3 are provided in their end surfaces with two notches 3*b* through each of which one of the wires 7 passes into a recess defined by septums 3 and the arcuate wall sections 2*a*. A cylindrical transducer unit generally indicated at 10 is received in that recess, and fits snugly between the cylindrical surface of section 2*a* and the cylindrical surface 3*a*. The wires 7** are connected to the transducer.

Figure 10:
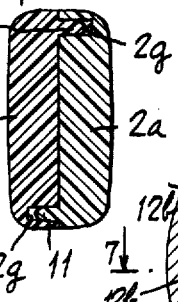
FIG. 10 is a sectional view, on a smaller scale, taken along the line 10—10 of FIG. 3.

A locating pin 11 projects from the wall section **2*a*, at a point spaced from the longitudinal axis of the housing part 2. A recess 2*g* for receiving a similar pin is provided in the wall section 2*a*. The locating pin 11 and the recess 2*g* are spaced from the longitudinal axis of the housing part by equal distances and on opposite sides thereof from one another, so that when one of the two housing parts is inverted and the end surfaces of their peripheral walls are placed in contact, the pin 11 on each housing part enters the recess 2*g* on the other housing part, as best seen in FIG. 10**. After being so assembled, the two parts can be fastened together by sonic welding, bonding or the like.

Figure 6:
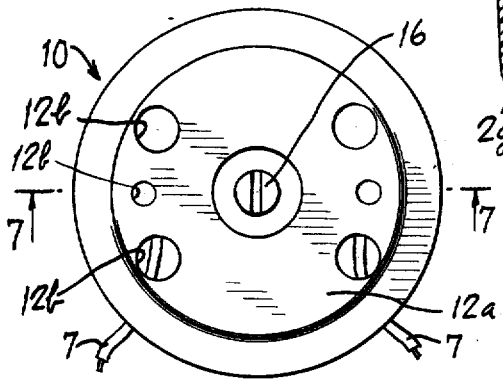
FIG. 6 is a plan view of a transducer employed in the microphone.
Figure 8:
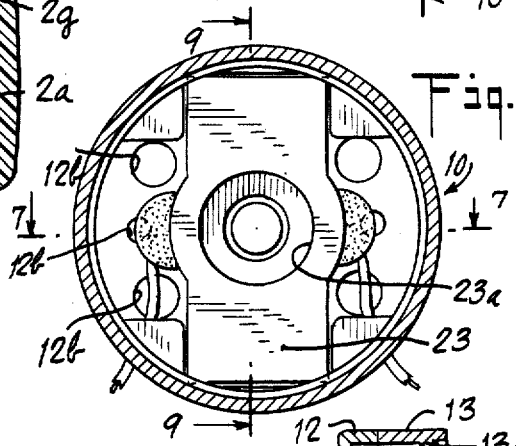
FIG. 8 is a sectional view of the transducer in the microphone of FIG. 7, taken along the line 8—8 of that figure.
Figure 9:
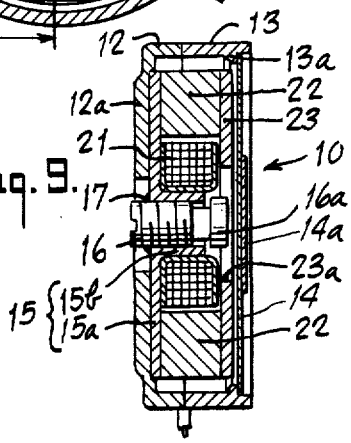
FIG. 9 is a sectional view taken along the line 9—9 of FIG. 8.

The transducer 10 comprises a first cylindrical frame member 12, which is open at its right-hand end as viewed in FIG. 9. The opposite end of the frame member 12 is closed by a wall **12*a* having openings 12*b* (FIGS. 6 and 8**) formed therein.

A second cylindrical frame member 13 is ring shaped and abuts the open end of the first frame member, as best seen in FIG. 9. The frame members 12 and 13 are attached to each other, as by bonding, at their abutting surfaces. A diaphragm 14 (FIG. 7) of magnetic material is seated at its periphery on a shoulder 13*a* on the seocond frame member 13. At its center, the diaphragm carries an armature 14*a* of magnetic material.

The diaphragm 14 and armature 14*a* are part of a magnetic circuit means which includes a central member 15 having a flange 15*a* attached as by bonding to the wall 12*a* of the frame member 12, and an integral sleeve 15*b* extending to the right as it appears in FIG. 9 from the flange 15*a*. A pole piece 16 is threaded into the sleeve 15*b*, and projects beyond the sleeve, integrally carrying at its projecting end a pole 16*a* which cooperates with the armature 14*a*, and is spaced therefrom by a distance which may be adjusted by rotating the threaded pole piece 16. After final adjustment, the pole piece is fixed in place, as by cement 17. An electromagnetic coil 21 is mounted on the outside of the sleeve 15*b*, and has its ends connected to the wires 7. A pair of permanent magnets 22 extend between the flange 15*a* and a peripheral pole piece 23 having a central aperture 23*a* concentric with the pole 16*a*. The pole 16*a*, diaphragm 14, the armature 14*a*, central member 15, the magnets 22 and the peripheral pole piece 23 together constitute the magnetic circuit means cooperating with the coil 21. After the diaphragm 14 is in place, as shown, it is held there by the attractive force of the permanent magnets 22 acting on the diaphragm and the armature 14*a*.

Figure 4:
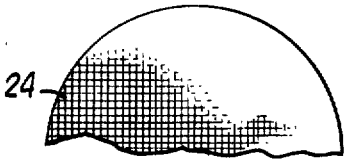
FIG. 4 is a plan view of a screen which serves as a first acoustic impedance in the microphone.
Figure 7:
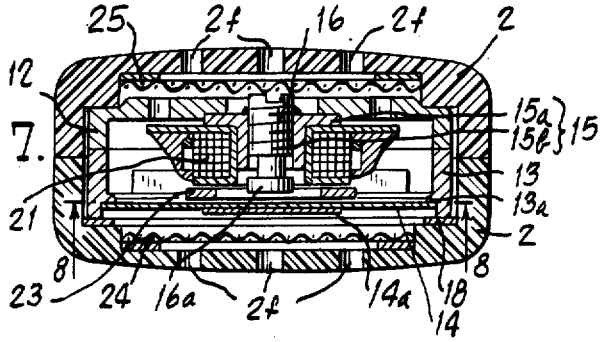
FIG. 7 is a cross-sectional view of the microphone of FIG. 1 taken on the line 7—7 of FIGS. 2, 6 and 8.

The acoustic path between the openings 2*f* in the lower housing part 2, as it appears in FIG. 7, and the under side of the diaphragm 14, is short and direct and extends through the openings 2*f* and thence through a screen 24 (FIGS. 2, 4 and 7) of relatively fine mesh and through the space immediately under the diaphragm 14.

Figure 5:
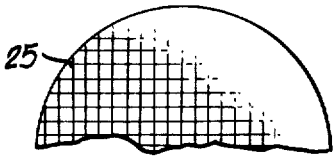
FIG. 5 is a plan view of another screen which serves as a second acoustic impedance in the microphone.

The acoustic path between the openings 2*f* in the upper housing part 2, as it appears in FIG. 7, and the upper side of the diaphragm 14, is longer and more tortuous. It extends through the openings 2*f*, a screen 25 (FIGS. 2, 5 and 7) of relatively coarse mesh, openings 12*b* in the frame member 12, into the space within the frame members 12 and 13, and around the central member 15 and the coil 21 mounted thereon, to the upper side of diaphragm 14.

The lower end of the frame member 13, as viewed in FIGS. 2 and 7, extends downwardly beyond the shoulder 13*a*. A sealing washer 18, which may be a sheet of paper, Mylar, or other suitable material, coated on both sides with a pressure sensitive adhesive, is located between the lower end of the frame member 13 and the bottom of the inside of the lower housing part 2. The lower frame member 13, the sealing washer 18, and the diaphragm 14 cooperate to separate the two acoustic paths from each other.

It is desirable to match the frequency response curve of the transducer 10 with respect to sound impinging on it through the openings 2*f* in the upper housing part 2 with the frequency response curve of the transducer to sound impinging on it through the openings 2*f* in the lower housing part 2. The acoustic path between the openings 2*f* in the lower housing part 2 and the diaphragm 14 is shorter than the acoustic path between the openings 2*f* in the upper housing member and the diaphragm 14. In order to match the two frequency response curves, acoustic resistances are introduced into the two paths. The acoustic resistances are provided by the screens 24 and 25. The screen 24 is made with a finer mesh than the screen 25. Compare FIGS. 4 and 5. The screen 24 introduces greater loss into the acoustic path leading to the under side of the diaphragm than the screen 25 introduces into the path leading to the upper side of the diaphragm. The losses are inversely related to the length of the paths. In this way, the acoustic paths between either sets of openings 2*f* and the diaphragm are substantially balanced so that the voice or other sounds to be picked up may be directed into either side of the microphone. The openings on the other side of the microphone thereupon serve as antinoise openings to receive background noise which tends to cancel, since it appears simultaneously at both sides of the diaphragm. With this structure, the frequency response spectrum of the microphone is substantially the same, whether the sound source is on one side of the microphone or the other, and the directivity pattern is substantially a figure eight.

I claim:

1. A reversible anti-noise microphone, including:

a. a housing comprising two identical parts, each part including:
   1. a peripheral wall; and
   2. a transverse wall, each said transverse wall defining a face of the housing;

b. means fastening the housing parts together with said peripheral walls abutting and said transverse walls spaced apart and forming first and second opposite faces with at least one sound transmitting opening in each face;

c. a transducer enclosed in the housing including a diaphragm having opposite surfaces;

d. means defining a first acoustical path providing communication between the opening in the first face of the housing and a first surface of said diaphragm;

e. means defining a second acoustical path providing communication between the opening in the second face of the housing and a second surface of the diaphragm, said first path being acoustically longer than the second path;

f. first acoustical resistance means in the first path; and g. second acoustical resistance means in the second path, said second acoustical resistance means having a greater acoustical loss than the first acoustical resistance means, the losses being inversely related to the lengths of said paths so that the frequency response curves of the two paths are substantially the same.

2. A microphone as in claim 1, in which each of the two housing parts includes first and second transverse septums separating the interior of the housing part into three recesses;

a. said peripheral wall including a first section having a part-cylindrical inner face greater than a semicylinder and second and third sections having flat inner surfaces extending tangentially from the first section and converging to an end section;

b. said first transverse septum having a part-cylindrical surface cooperating with the inner face of said first wall section to define a first of said three recesses, said transducer being received in said first recess;

c. said second transverse septum extending between said second and third wall sections and cooperating therewith and with said first transverse septum to define a second recess;

d. said second transverse septum cooperating with said second and third wall sections and said end section to define a third recess for receiving a conduit anchor, said end section having a passage therein for receiving a conduit;

e. said second transverse septum having a notch for receiving two wires from said conduit;

f. said first transverse septum having a notch at each end for receiving a wire from said conduit; and g. said first and second transverse septums cooperating with said notches to define tortuous strain relieving passages for said wires.

3. A microphone including:

a. a housing comprising:

1. two abutting parts of similar form, said housing having two opposed faces, at least one face having a sound transmitting opening therein, each said housing part including:

i. a peripheral wall, and a transverse wall, each transverse wall defining a face of the housing; and ii. means fastening the housing parts together with the peripheral walls abutting;

b. a transducer in the housing including two electrical terminals, and a diaphragm upon which sound passing through the opening impinges;

c. each of the two housing parts including first and second transverse septums;

d. each said peripheral wall including a first section having a part-cylindrical inner face greater than a semi-cylinder and second and third sections having flat inner surfaces extending tangentially from the first section and converging to an end section;

e. said first transverse septums having part-cylindrical surfaces cooperating with the inner faces of said first wall sections to define a cylindrical recess receiving the transducer;

f. said second transverse septums extending between said second and third wall sections and cooperating therewith and with said first transverse septums to define a second recess;

g. said second transverse septums cooperating with said end sections and said second and third wall sections to define a third recess receiving a conduit anchor, said end sections having cooperating notches defining a passage therein receiving a conduit;

h. said second transverse septums having opposed notches receiving wires extending from said conduit;

i. said first transverse septums having opposed notches at each end, each pair of opposed notches receiving a wire from said conduit; and j. said first and second transverse septums cooperating with said notches to define tortuous strain relieving passages for said wires.

4. A microphone as in claim 3, in which said fastening means comprises a locating pin projecting from the abutting surface of the peripheral wall at a point spaced from the longitudinal axis of the housing part, and a recess in said abutting surface for receiving a similar locating pin, said recess being located at a point spaced from the longitudinal axis of the housing part on the opposite side thereof from said locating pin, said pin and recess being symmetrically spaced.

* * * * *